US006201877B1

(12) United States Patent
Chang

(10) Patent No.: US 6,201,877 B1
(45) Date of Patent: Mar. 13, 2001

(54) ADJUSTABLE HOLDER FOR AN ACOUSTIC PICK-UP DEVICE

(75) Inventor: Chao-Chih Chang, Taichung (TW)

(73) Assignee: Taiwan Carol Electronics Co., Ltd. (TW)

( * ) Notice: Subject to any disclaimer, the term of this patent is extended or adjusted under 35 U.S.C. 154(b) by 0 days.

(21) Appl. No.: 09/384,712

(22) Filed: Aug. 26, 1999

(51) Int. Cl.[7] ..... H04R 25/00
(52) U.S. Cl. ..... 381/364; 381/374; 381/375
(58) Field of Search ..... 381/355, 361, 381/364, 366, 367, 151, 385, 370, 374, 375, FOR 147, FOR 148; 455/90, 100, 348, 351; 181/129, 128

(56) References Cited

U.S. PATENT DOCUMENTS 5,163,093 * 11/1992 Frielingsdorf et al. ..... 381/364
5,701,356 * 12/1997 Standford et al. ..... 381/370

* cited by examiner

*Primary Examiner*—Huyen Le
(74) *Attorney, Agent, or Firm*—Skjerven Morrill MacPherson LLP; Alan H. MacPherson

(57) ABSTRACT

A holder for an acoustic pick-up device includes a base and a neck strap. The base is adapted for mounting of the pick-up device thereon, and is formed with a strap fastener. The strap fastener includes a pair of tubular strap sleeves that define a pair of strap holes. The neck strap has two ends that are extended respectively through the holes in the strap sleeves. The neck strap is gripped fittingly and is compressible in radial directions by the strap sleeves. The base can be forced to move along the length of the neck strap when adjusting the position of the base relative to the neck strap.

5 Claims, 6 Drawing Sheets

ADJUSTABLE HOLDER FOR AN ACOUSTIC PICK-UP DEVICE

BACKGROUND OF THE INVENTION

1. Field of the Invention

The invention relates to an acoustic pick-up device, more particularly to a holder for an acoustic pickup device that can be hung around the neck of the user and that can be adjusted as desired.

2. Description of the Related Art

FIGS. 1 and 2 illustrate a conventional acoustic pick-up device 10 that can be attached to the clothes of the user to eliminate the need for gripping by the hands of the user. The pick-up device 10 is mounted on a base 11 that is provided with a clip 12. In use, the clip 12 is generally fastened to the collar 141 of a shirt or blouse 14 of the user 13. It is noted that the clip 12 is difficult to fasten on the shirt or blouse when the collar is a round-neck collar. In addition, the clip 12 can form crease marks on the collar when it is fastened too tight, and can fall off from the collar when it is fastened too loose.

FIG. 3 illustrates a conventional microphone 20 that is provided with a neck strap 21 for hanging the microphone 20 on the neck 221 of the user 22. However, aside from an unpleasant appearance, the drawbacks of poor sound pick-up and inconvenient adjustment are commonly associated with such a design.

SUMMARY OF THE INVENTION

Therefore, the object of the present invention is to provide a holder for an acoustic pick-up device that can be hung around the neck of the user, that can be adjusted as desired, and that has a pleasant appearance.

According to this invention, a holder for an acoustic pick-up device comprises a base and a neck strap. The base is adapted for mounting of the pick-up device thereon, and is formed with a strap fastener. The strap fastener includes a pair of tubular strap sleeves that define a pair of strap holes. The neck strap has two ends that are extended respectively through the holes in the strap sleeves, and is gripped fittingly and is compressible in radial directions by the strap sleeves. The base can be forced to move along the length of the neck strap when adjusting the position of the base relative to the neck strap.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
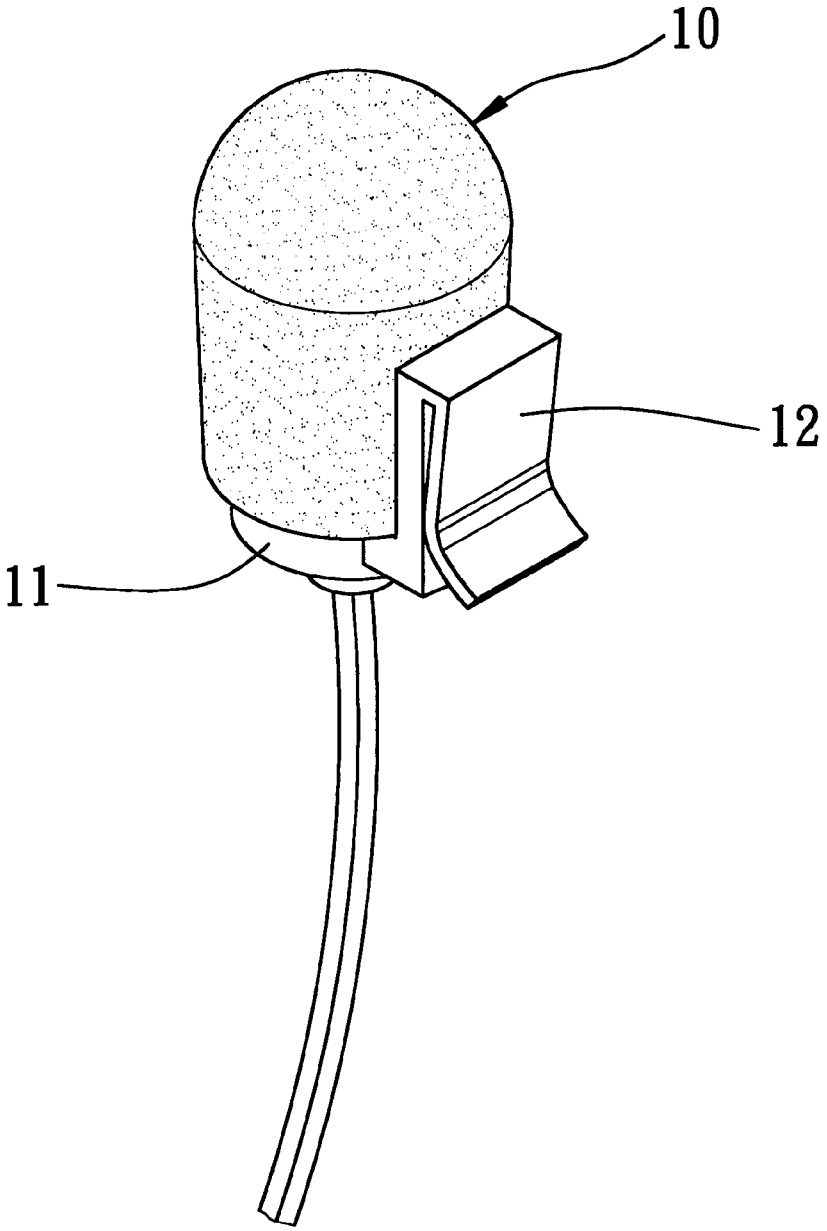
FIG. 1 PRIOR ART
FIG. 1 is a perspective view illustrating a conventional acoustic pick-up device.
Figure 2:
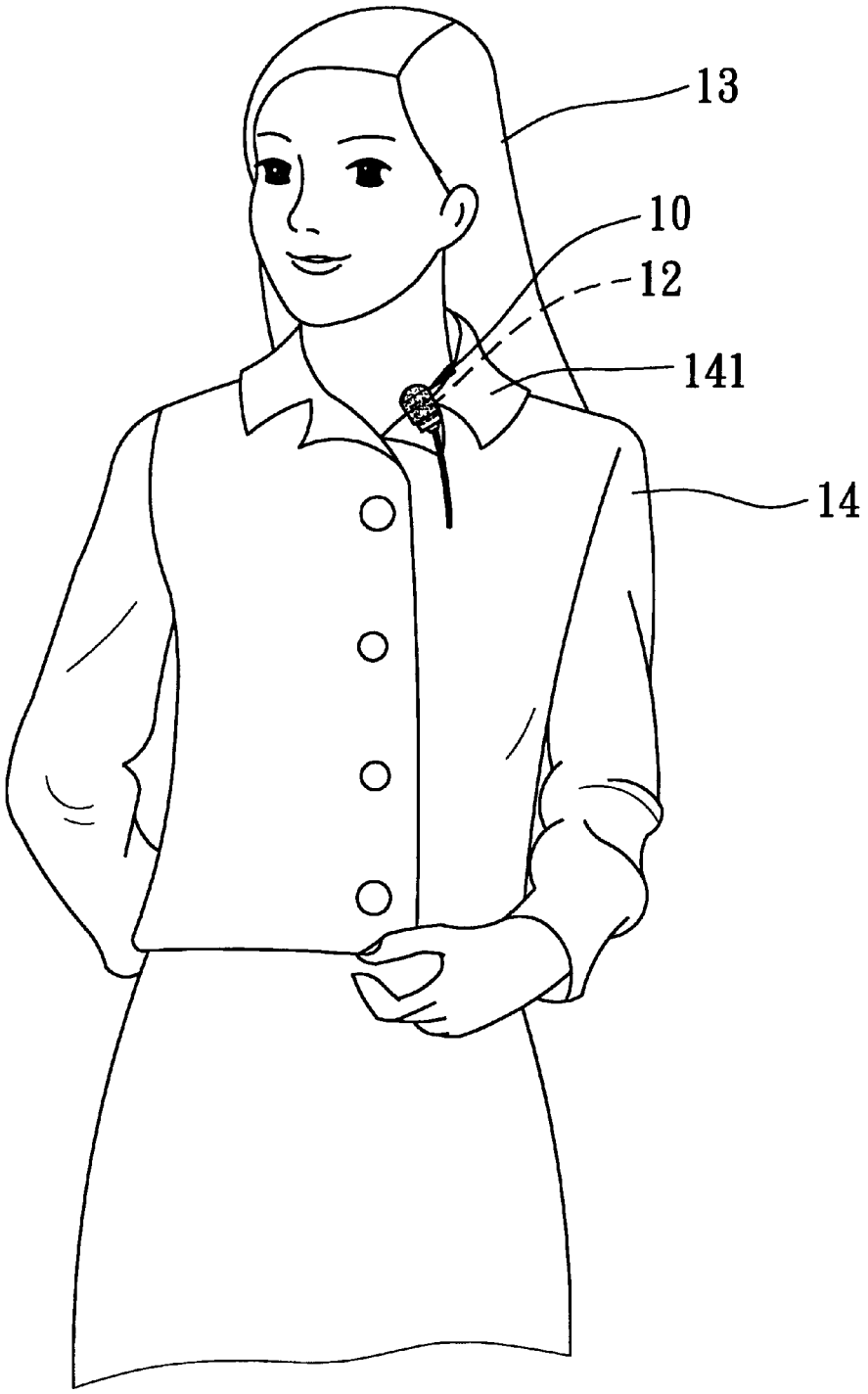
FIG. 2 PRIOR ART
FIG. 2 shows the conventional acoustic pick-up device of FIG. 1 in a state of use.
Figure 3:
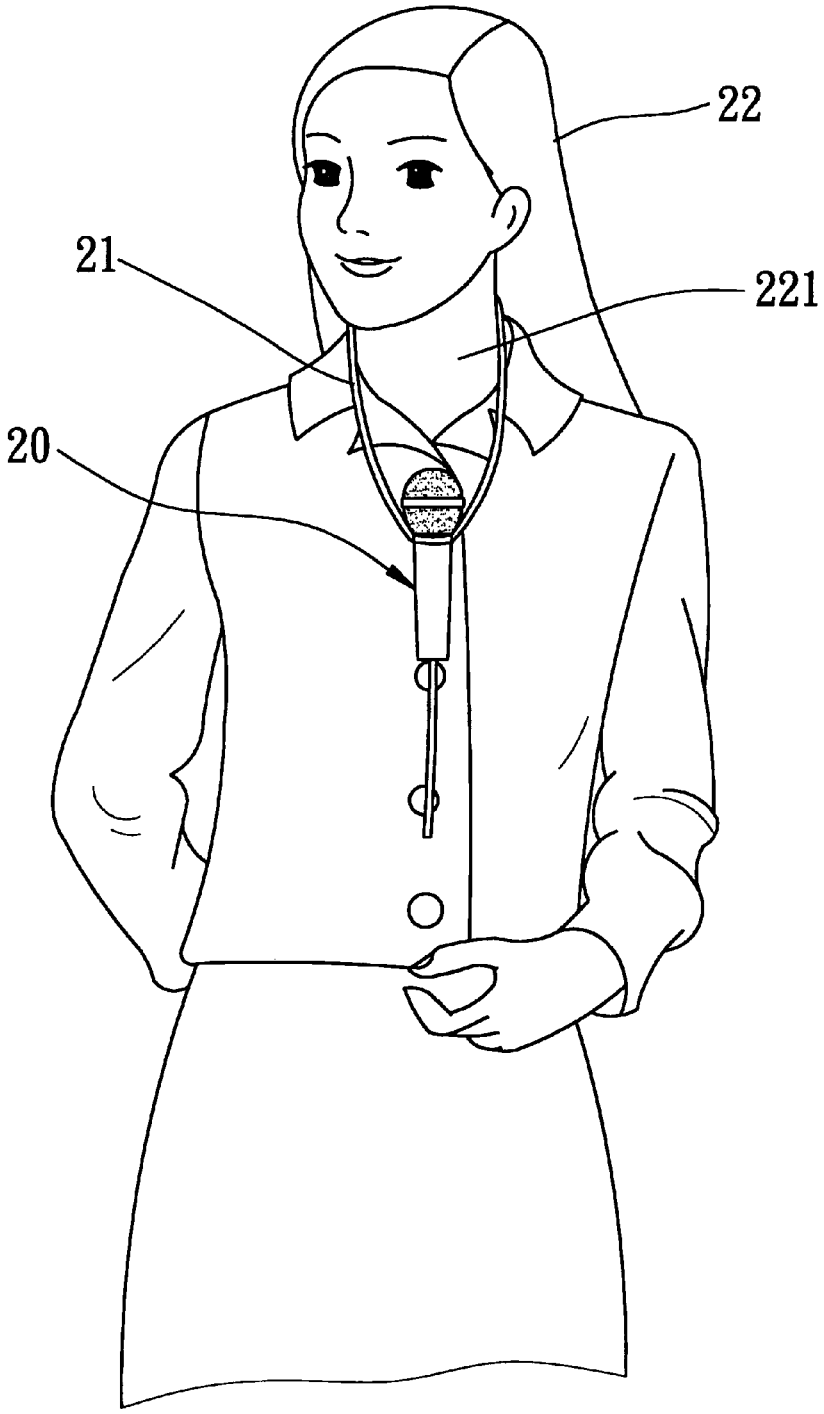
FIG. 3 PRIOR ART
FIG. 3 shows a conventional microphone that is provided with a neck strap in a state of use.
Figure 4:
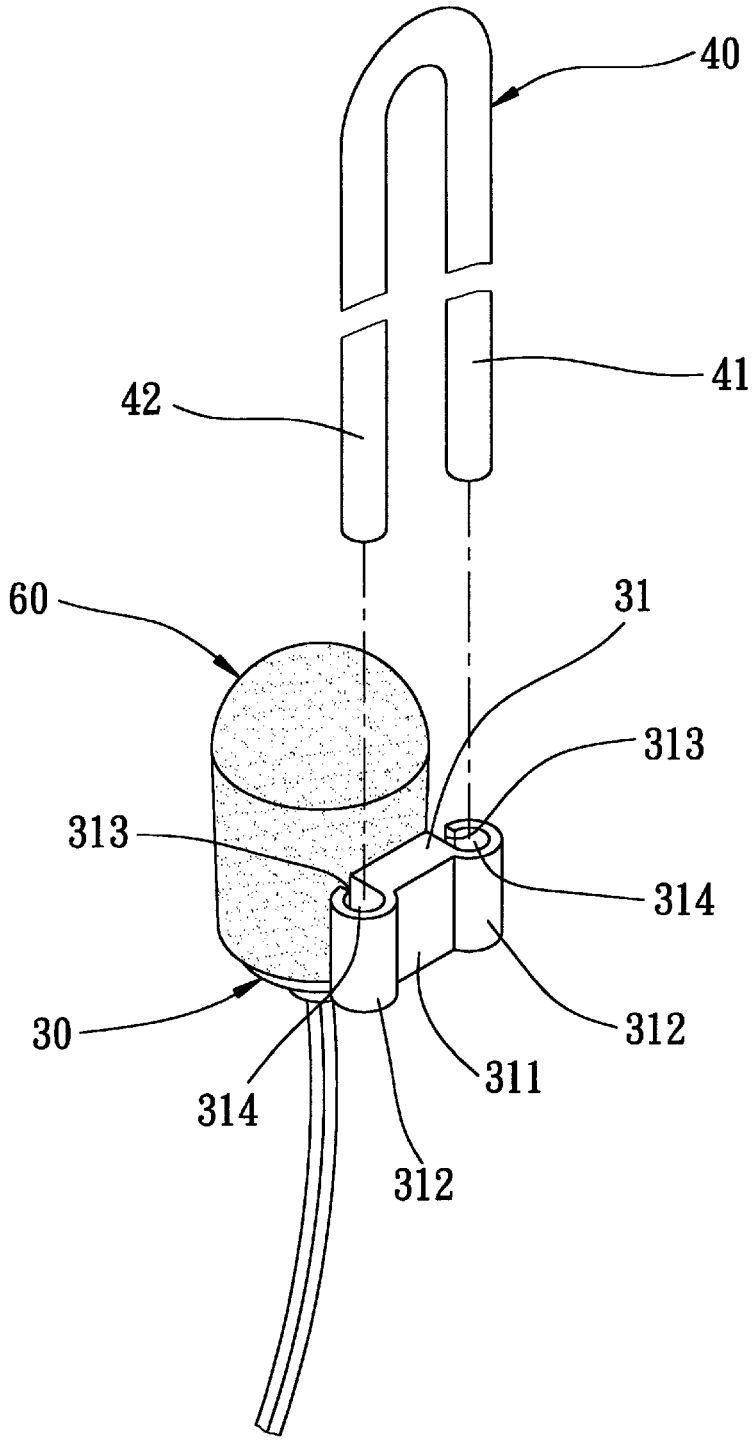
FIG. 4 is perspective view of the preferred embodiment of a holder for an acoustic pick-up device according to the present invention.
Figure 5:
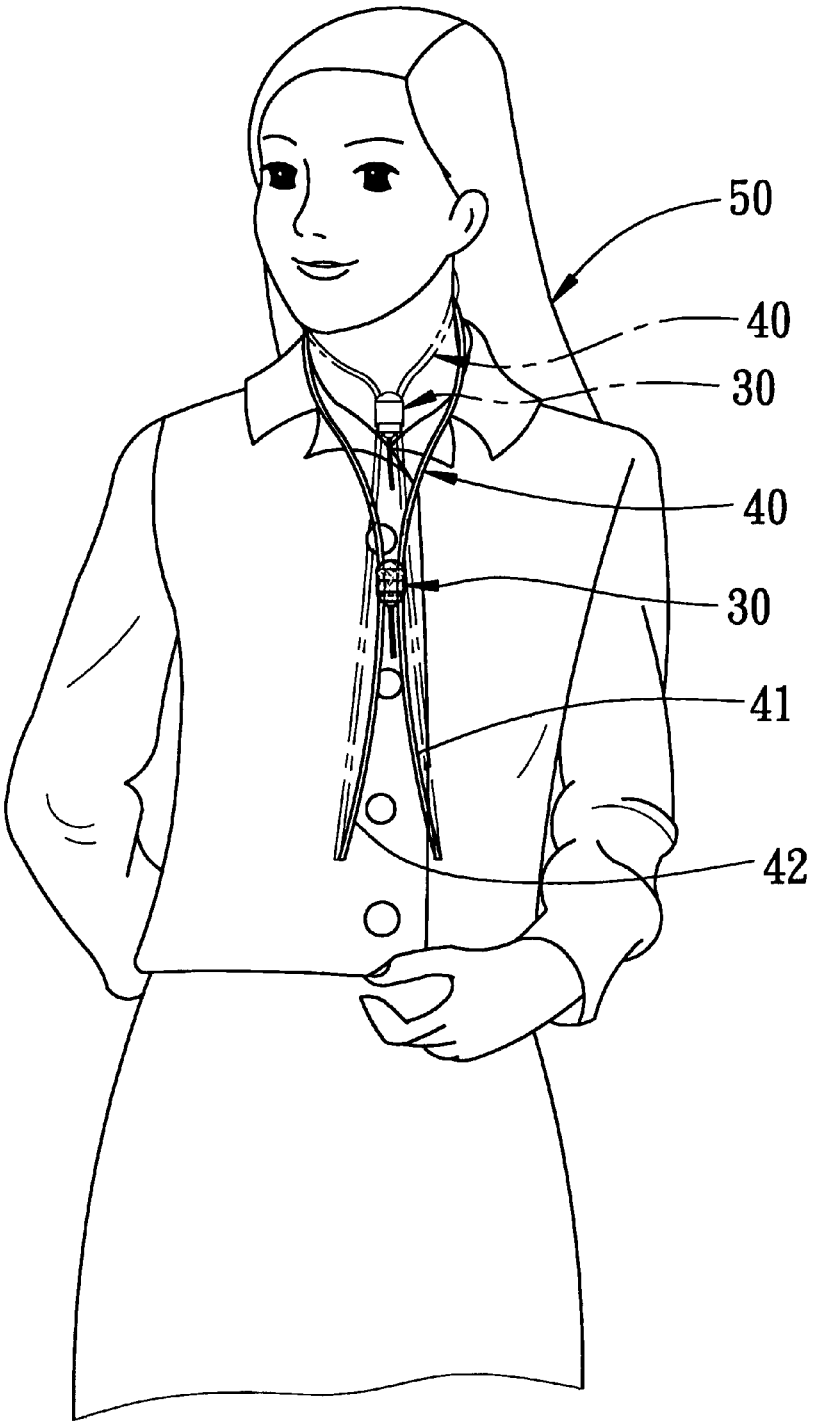
FIG. 5 shows the preferred embodiment in a state of use.
Figure 6:
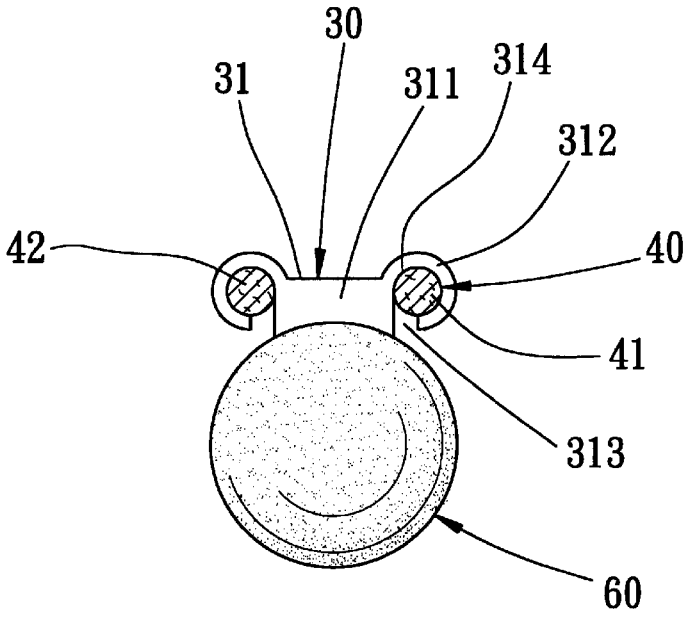
FIG. 6 is a schematic top view of the preferred embodiment.
Figure 7:
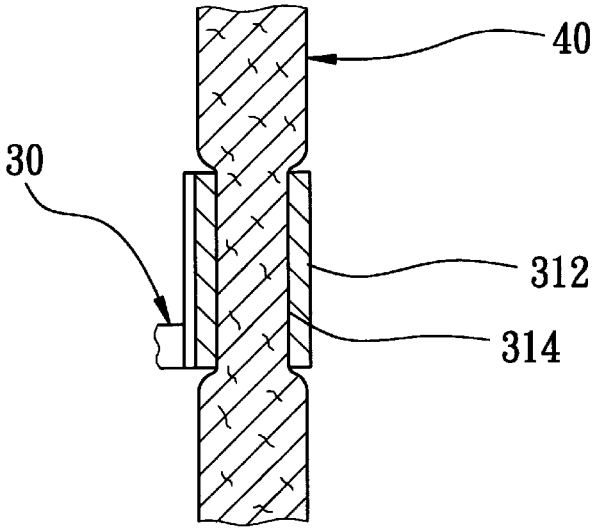
FIG. 7 is a cross-sectional view illustrating a neck strap and a strap sleeve of the preferred embodiment.

Referring to FIGS. 4 to 7, the preferred embodiment of a holder for an acoustic pick-up device 60 according to this invention is shown to comprise a base 30 and a flexible neck strap 40.

The base 30 is adapted for mounting of the pickup device 60 thereon, and is formed integrally with a strap fastener 31. The strap fastener 31 includes a parallel pair of tubular strap sleeves 312 and a connecting block 311 that extends between and that interconnects the strap sleeves 312. Each of the strap sleeves 312 defines a strap hole 314, and is formed with an axially extending slit 313 to enhance resiliency of the strap sleeves 312. The neck strap 40 has two ends 41, 42 that are extended respectively through the holes 314 in the strap sleeves 312. Preferably, the strap fastener 31 is made from rubber or plastic, and the neck strap 40 is made from cotton threads. The neck strap 40 has a diameter that is slightly larger than the diameter of the strap holes 314 so that the neck strap 40 is gripped fittingly and is compressed in radial directions by the strap sleeves 312. Due to the properties of the neck strap 40, the portions of the neck strap 40 on upper and lower sides of the strap sleeves 312 resist undesired movement of the base 30 along the neck strap 40. However, the base 30 can be forced to move along the length of the neck strap 40 when adjusting the position of the same.

In use, the neck strap 40 can be worn around the neck of the user 50 for hanging of the base 30, together with the pick-up device 60, thereon.

It can be understood from the foregoing that, aside from the advantages of ease of adjustment and positioning of the pick-up device 60 for optimum sound pick-up, the holder of this invention does not leave crease marks on the clothes of the user and is not liable to fall off during use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A holder for an acoustic pick-up device, comprising:

a base adapted for mounting of the pick-up device thereon, said base being formed with a strap fastener, said strap fastener including a pair of tubular strap sleeves that define a pair of strap holes; and a neck strap having two ends that are extended respectively through said holes in said strap sleeves, said neck strap being gripped fittingly and being compressible in radial directions by said strap sleeves, said base being forcible to move along length of said neck strap when adjusting position of said base relative to said neck strap.

2. The holder of claim 1, wherein said strap fastener further includes a connecting block that extends between and that interconnects said strap sleeves.

3. The holder of claim 1, wherein said neck strap has a diameter that is slightly larger than that of said strap holes.

4. The holder of claim 3, wherein said neck strap is formed from cotton threads, and said strap fastener is formed from a plastic material.

5. The holder of claim 1, wherein each of said strap sleeves is formed with an axially extending slit.

* * * * *